United States Patent [19]

Svoboda

[11] 4,194,759

[45] Mar. 25, 1980

[54] BRAKE MECHANISM FOR A SKI

[75] Inventor: Josef Svoboda, Schwechat, Austria

[73] Assignee: TMC Corporation, Baar, Switzerland

[21] Appl. No.: 900,303

[22] Filed: Apr. 26, 1978

[30] Foreign Application Priority Data

Apr. 27, 1977 [AT] Austria ..... 2938/77

[51] Int. Cl.[2] ..... A63C 7/10

[52] U.S. Cl. ..... 280/605

[58] Field of Search ..... 280/605, 604, 633, 636

[56] References Cited

U.S. PATENT DOCUMENTS

| | | | |
|---|---|---|---|
| 3,924,864 | 12/1975 | Weigl | 280/605 |
| 3,930,659 | 1/1976 | Sazomon | 280/605 |

FOREIGN PATENT DOCUMENTS

| | | | |
|---|---|---|---|
| 2436155 | 2/1976 | Fed. Rep. of Germany | 280/605 |
| 2527925 | 9/1976 | Fed. Rep. of Germany | 280/605 |
| 2606988 | 9/1976 | Fed. Rep. of Germany | 280/605 |
| 2517829 | 11/1976 | Fed. Rep. of Germany | 280/605 |
| 2606988 | 9/1976 | Fed. Rep. of Germany | 280/605 |
| 2311566 | 12/1976 | France | 280/605 |
| 2314740 | 1/1977 | France | 280/605 |

*Primary Examiner*—David M. Mitchell

*Attorney, Agent, or Firm*—Blanchard, Flynn, Thiel, Boutell & Tanis

[57] ABSTRACT

A U-shaped ski brake made of spring wire wherein intermediate the legs of the U, the spring wire is bent to form laterally extending axles to define a pivotal support for the ski brake. The intermediate portion of the length of the spring wire extending between the axles is also U-shaped and is connected to the inner ends of the axles. The legs of the holding bars are prestressed so that they extend, when the ski brake is in the braking position, at an angle which is greater than 90° to the longitudinal axis of the axles. A slide is mounted on the holding arms and is reciprocal along the length thereof. The spacer has holes receiving the holding arms therein so that as the slider moves along the holding arms, the resiliency of the spring wire will cause the brake arms to move laterally inwardly and outwardly relative to the outer edges of the ski. The spacer is pivotally secured through a lever arm to a mounting plate, the same plate to which the spring wire is pivotally secured. A spacing between the pivotal support for the lever and the axles causes, when the ski brake is erected from the retracted position to the ski braking position, a longitudinal sliding movement of the slider along the holding arms.

8 Claims, 7 Drawing Figures

BRAKE MECHANISM FOR A SKI

CROSS REFERENCE TO RELATED APPLICATION

This application is related to U.S. Patent Application Ser. No. 900,296, filed Apr. 26, 1978.

FIELD OF THE INVENTION

The invention relates to a brake mechanism for a ski comprising braking arms which are arranged on both sides of the ski and which are pivotally supported, which braking arms are also laterally movable, preferably along their pivot axes, and are connected to the holding arm portions of the ski brake. Such ski brakes have the purpose of automatically stopping the ski following a fall of the skier and a release of the safety binding. This is achieved by the braking arms, which are arranged on both sides of the ski, swinging beneath the running surface of the ski. When the ski boot is again inserted into the ski binding, the braking arms are swung into the downhill or retracted position, so that they extend substantially parallel to the upper side of the ski. The brake arms do not project, or only insignificantly project laterally beyond the edges of the ski, in order to not offer any resistance during a sloped travel or during travel in deep snow.

BACKGROUND OF THE INVENTION

Depending on the type of construction or the purpose of use, skis have different widths so that it has been common up to now to select the spacing between the braking arms of such a size that the brake mechanisms for skis are suitable for all types of constructions of skis. However, these known brake mechanisms cannot meet the above conditions and are therefore not well suited for use.

One has now tried to reduce this disadvantage by moving the braking arms during their upward swing from the braking position into the downhill or retracted position toward one another, and by thus pulling them in, if desired, totally or partly onto the upper side of the ski. However, such a pulling in of the braking arms is possible only to a limited extent so that these conventional ski brakes have only a very limited field of use and cannot be used for all ski widths which are common today.

On the other hand, ski brakes also have already become known, in which the braking arms rest elastically on the narrow sides of the skis, which facilitates an adjustment to the respective width of the ski. Such a construction, however, has the disadvantage that both the narrow sides of the skis and also in particular the braking arms are subjected to a heavy wear due to the sharp edges of the skis. Also considerable frictional forces can be created thereby, which reduce the effective erecting power of the braking arms.

Therefore, the basic purpose of the invention is to provide a brake mechanism for skis which can be adjusted to all common ski widths by avoiding the above-mentioned disadvantages.

The invention provides structure for permitting the spacing between the braking arms to be adjustable by means of a spacer which connects both holding arms.

This spacer has preferably two openings, through which the holding arms of the ski brake extend. The spacing between the braking arms can now be adjusted at an optimum to the respective ski width, by for example exchanging the spacer in correspondence with the respective ski width, or by varying the width of the spacer. For this purpose, the spacer preferably has two webs which extend between the holding arms, the relative length of which webs can be adjusted by bending toward one another or away from one another, for example by means of a screw or an eccentric.

It can also be advantageous if the spacer consists of profiled parts which can be moved one in the other, the position of which can be fixed for example by means of a screw.

A preferred exemplary embodiment for adjusting the spacing between the braking arms is characterized by the spacer being movable along the holding arms and by the holding arms extending sloped or curved to one another. Thus, it is possible by a simple movement of the spacer along the holding arms to adjust the spacing between the braking arms corresponding with the width of the skis. The spacer is thereby preferably movably guided in dependency of the path of swing of the holding arms along said holding arms, so that the spacing between the braking arms changes in addition in dependency from their respective position. Thus an automatic pulling in of the braking arms during movement of the same from the braking position into the downhill or retracted position can be achieved. It is preferable when the spacer is pivotally secured to a holding or base plate through a lever. To adjust the spacing between the braking arms to the respective ski width, it is preferable if the effective lever length is variable, in particular if the position of the spacer can be adjusted on the lever by means of a setscrew.

BRIEF DESCRIPTION OF THE DRAWINGS

The invention will be discussed more in detail hereinafter with reference to the exemplary embodiments and with reference to the drawings, which embodiments are not to be limiting.

FIG. 1 is a top view of an inventive ski brake in the downhill position and adjusted to the ski width a;

DETAILED DESCRIPTION

Figure 1:
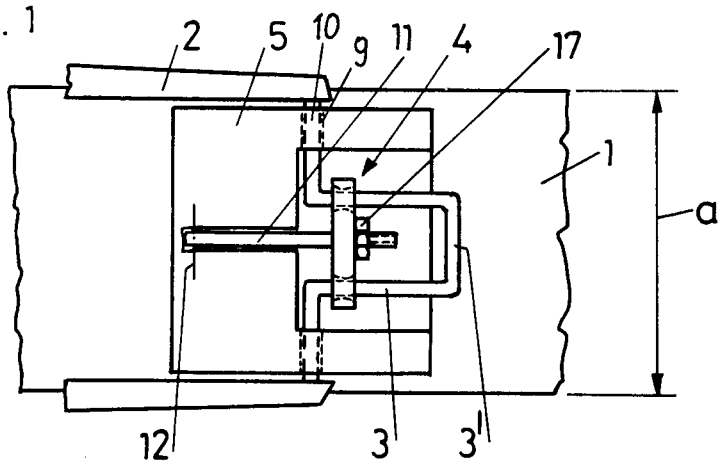

The ski brake which is illustrated in FIG. 1 utilizes a holding or base plate 5 fixed to the ski 1. The holding or base plate 5 has two bearing recesses 9, which receive the pivot axles 10 of the two braking arms 2 therein. The bearing recesses 9 are constructed such that the pivot axles 10 are axially movable therein. The holding arms 3 of a U-shaped pedal are connected to the pivot axles 10 and to each other through a crossbar 3'. Both of the pivot axles 10 and also the holding arms 3 are manufactured preferably in one piece and of spring wire. The two braking arms 2 are now divergingly pretensioned, which can be achieved in turn by a suitable pretensioning of both the holding arms 3 and also the crossbar 3'. A spacer 4 is connected to the two holding arms 3 and is pivotally secured through a lever 11 and a pivot joint 12 to the holding plate 5. The joint 12 is thereby arranged at a spaced relation from the bearing recesses 9.

Figure 2:
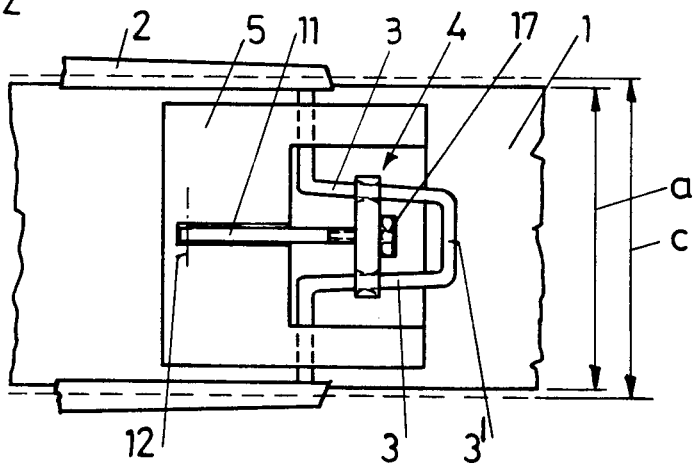
FIG. 2 illustrates the same ski brake adjusted to the ski width c, which is indicated by dashes.

Furthermore, the lever 11 has at its free end a thread, on which a nut 17 is threadedly engaged. By rotating the nut 17, it is now possible to change the position of the spacer 4 along the length of the holding arms 3, as is indicated in FIG. 2. As a result, the holding arms 3 are urged apart according to the degree of their pretension, which again has the consequence that the spacing between the two braking arms 2 is increased. A further advantage of this construction is that the spacer slides further along the holding arms 3 during a downward swing of the two braking arms 2 or during an upward swing of the holding arms 3 due to the spatial relation between the axles 10 and the pivot joint 12 along the longitudinal axis of the ski 1, which effects a further lateral outward movement of the two braking arms during a swing of the braking arms 2 into the braking position or an inward movement of the two braking arms during a swing of the same into the downhill or retracted position. In order to satisfactorily assure this function, it is necessary to construct the openings in the spacer 4, in which the holding arms 3 are guided, approximately in the shape of a double cone or a rotary hyperboloid. Furthermore, it can be seen that due to the construction of the ski brake, namely, in particular due to the pretensioning of the holding arms 3 and of the crossbar 3', an independent swinging of the braking arms 2 outwardly into the braking position is effected. This pretensioning which effects the aforementioned swinging out of the braking arms 2 can, however, be reinforced as desired for example by arranging a stepping plate and by pretensioning the same into the braking position.

Figure 3:
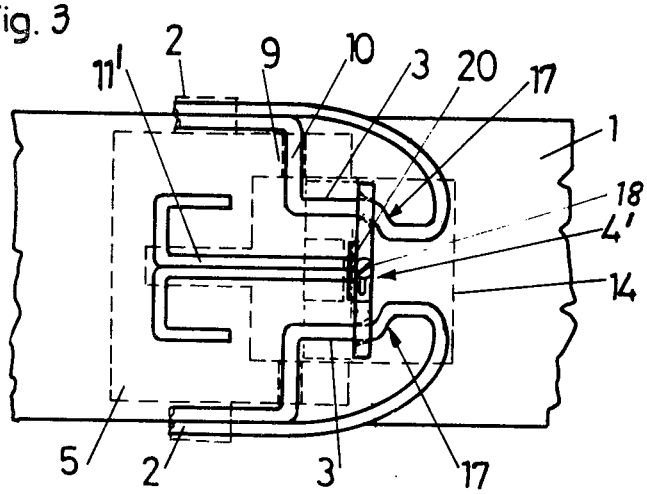
FIG. 3 is a top view of a ski brake in the downhill position having a width-adjustable spacer.
Figure 4:
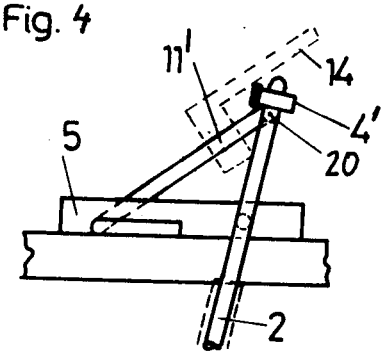
FIG. 4 is a side view of this ski brake in the braking position.

FIGS. 3 and 4 illustrate an exemplary embodiment with a width-adjusting spacer 4'. The braking arms 2 are again supported for lateral movement on a holding plate through bearing recesses 9 and pivot axles 10 received in the recesses. Furthermore, the spacer 4' is connected through a lever 11' to the holding or base plate 5. The lever 11' is pretensioned in the braking position as is indicated in FIG. 4 by its ends, which are secured to the holding plate, being bent into the plane of the same. The spacer and the lever 11' are connected through a pivot joint 20.

To adjust the spacing between the two braking arms 2 to the respective width of the ski 1, the width of the spacer 4' is adjustable and can be fixed by means of a screw 18 after a change has been made.

In order to effect a pulling in or drawing in of the braking arms 2 shortly before reaching the downhill or retracted position, the holding arms 3 have a double bend as at 17. Thus, when the holding arms 3 are swung upwardly from the position illustrated in FIG. 3 into the braking position according to FIG. 4, the spacer 4', while sliding along the holding arms 3, effects through said double bend 17 a moving apart of the braking arms 2. A stepping plate 14 can furthermore be mounted on the lever 11'.

Figure 5:
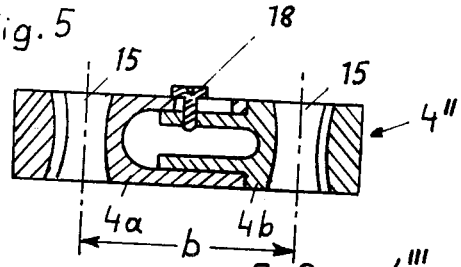

FIG. 5 illustrates a modification of a width-adjusting spacer 4'', which consists of a profiled first part **4*a* and a profiled second part 4*b*. These profiles can have, for example, a cylindrical design and can be moved one into the other. The relative position therebetween can be fixed by means of a clamping screw 18. By moving these two profiled parts 4*a* and 4*b*, the effective width b of the spacer 4'' is now changed, because the holding arms 3 are received in and guided in the openings 15** therein.

Figure 7:
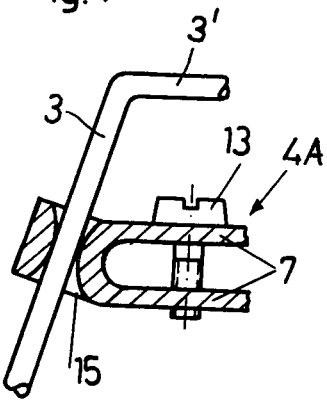
FIGS. 5, 6 and 7 illustrate modifications of width-adjustable spacers.
Figure 6:
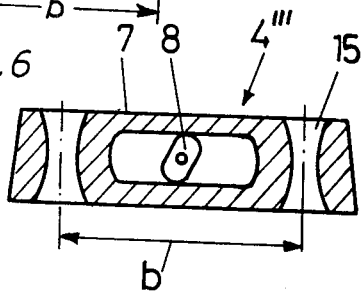

In the modification illustrated in FIG. 6, the width adjusting spacer 4''' has two webs 7' which extend between the part of spacer 4''' having the openings 15 therein for receiving the holding arms, which webs 7' can be spread apart by means of an eccentric member 8, so that their relative length is changed. As a result, the width b or the distance between the two openings 15 can be adjusted. In the exemplary embodiment which is illustrated in FIG. 7, the webs 7' of the spacer 4A can be bent relative to one another by means of a screw 13.

Many different exemplary embodiments are conceivable within the scope of the invention.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A brake mechanism for use on skis, comprising:

a base plate mounted on a top surface of said ski;

a pair of laterally spaced brake members and bearing means supporting said brake members on said base plate for pivotal movement about a pivot axis and for movement toward and away from each other along said pivot axis, said brake members each having a braking arm and a holding arm, said brake members each being pivotal between an operative position wherein said braking arms project beneath a bottom surface of said ski and said holding arms project upwardly away from said top surface of said ski and an inoperative position wherein said braking arms are located above said top surface of said ski and said holding arms extend generally parallel to said top surface of said ski, said holding arms extend at an acute angle to each other when in said operative position;

a slide piece having a pair of laterally spaced openings therein each receiving one of said holding arms therethrough, the spacing between said openings corresponding to the lateral spacing between said holding arms at the ends thereof closest the apex of said acute angle and when said holding arms are in said operative position; and adjustment means operatively connected to said slide piece for effecting a sliding of said slide piece along the length of said holding arms and an adjustment of the lateral spacing of said brake members in response to said adjustment movement of said slide piece to accommodate varying widths of skis.

2. A brake mechanism according to claim 1, wherein said brake members each have an axle segment extending parallel to said top surface of said ski and said pivot axis of which extends perpendicular to the longitudinal axis of said ski.

3. A brake mechanism according to claim 1, wherein said adjustment means is provided on said slide piece and includes two flexible weblike members which extend between said holding arms, the relative length of which weblike members can be adjusted by means of an adjustment member interposed therebetween to effectively move said weblike members toward and away from each other.

4. A brake mechanism according to claim 3, wherein said adjustment member is a rotatably supported eccentric.

5. A brake mechanism according to claim 3, wherein said adjustment member is a screw threadedly connected to at least one of said weblike members.

6. A brake mechanism according to claim 1, wherein the ends of said holding arms are connected through a crossbar member for initially prespring tensioning said holding arms at least one of toward and away from one another.

7. A brake mechanism according to claim 6, wherein the ends of said holding arms remote from said braking arms and adjacent said crossbar member have a smaller lateral spacing than at the ends thereof adjacent said braking arms, said slide piece moving during said adjustment movement between said ends of said holding arms adjacent said crossbar member and the ends adjacent said brake arms.

8. A brake mechanism according to claim 1, wherein said adjustment means includes a lever pivotally connected to said base plate and adjustably connected to said slide piece, said adjustment means including means for varying the effective length of said lever to effect said adjustment movement.

* * * * *